United States Patent [19]

Robinson

[11] Patent Number: 4,985,945

[45] Date of Patent: Jan. 22, 1991

[54] DOUBLE-LOCK SOFA SLEEPER MECHANISM

[75] Inventor: Danny C. Robinson, Carthage, Mo.

[73] Assignee: Leggett & Platt, Incorporated, Carthage, Mo.

[21] Appl. No.: 326,369

[22] Filed: Mar. 21, 1989

[51] Int. Cl.[5] ..... A47C 17/04

[52] U.S. Cl. ..... 5/13; 5/29

[58] Field of Search ..... 5/13, 29, 30, 31, 32, 5/33, 34, 35, 36, 28, 14

[56] References Cited

U.S. PATENT DOCUMENTS

| | | | |
|---|---|---|---|
| 2,844,827 | 7/1958 | Bank et al. . | |
| 3,024,473 | 3/1962 | Bebry et al. . | |
| 3,281,870 | 11/1966 | Katz . | |
| 3,281,871 | 11/1966 | Katz . | |
| 3,525,106 | 8/1970 | Perry . | |
| 3,868,733 | 3/1975 | Spitz et al. | 5/29 X |
| 3,934,281 | 1/1976 | Brindisi . | |
| 4,253,205 | 3/1981 | Mikos | 5/13 |
| 4,301,559 | 11/1981 | Greenbergne | 5/13 |
| 4,398,312 | 8/1983 | Duff | 5/13 |
| 4,439,878 | 4/1984 | Stevens | 5/13 |
| 4,571,755 | 2/1986 | Stevens . | |
| 4,590,630 | 5/1986 | Barabas | 5/13 |
| 4,780,918 | 11/1988 | Hartline | 5/13 |
| 4,800,598 | 1/1989 | Arft | 5/13 |
| 4,850,065 | 7/1989 | Swiderski et al. | 5/13 |
| 4,905,328 | 3/1990 | Pokorny | 5/29 |
| 4,918,770 | 4/1990 | Hartline et al. | 5/13 |

FOREIGN PATENT DOCUMENTS

| | | | |
|---|---|---|---|
| 1484752 | 6/1967 | France | 5/13 |

*Primary Examiner*—Eric K. Nicholson

*Attorney, Agent, or Firm*—Wood, Herron & Evans

[57] ABSTRACT

A foldable sofa sleeper mechanism having pivotally interconnected head, body, intermediate and foot sections movable between a folded position in which the mechanism is contained within a storage enclosure of a sofa frame, and an extended unfolded position in which the bed frame extends in a planar attitude away from the sofa frame, and double-lock means for securing the foot section of the bed frame in an overlying position relative to the body section of the bed frame when the sofa sleeper mechanism is folded within the storage enclosure.

5 Claims, 4 Drawing Sheets

DOUBLE-LOCK SOFA SLEEPER MECHANISM

This invention relates to a sofa sleeper and, more particularly, to a sofa sleeper of the type which includes a foldable bed having head, body, intermediate, and foot sections which are foldable and which may be collapsed and hidden in the bottom of the sofa frame when the sofa sleeper is used as a seating surface.

Sofa sleeper mechanisms generally comprise a four-section foldable bed frame including pivotally interconnected head, body, intermediate, and foot sections which are adapted to be moved between a fully folded or retracted position contained within a box-like sofa frame, and an extended position wherein the sections extend out and over the front rail of the sofa frame to form an extended flat bed. The head, body, intermediate and foot sections of the bed frame each include a pair of opposed side frame members, usually in the form of angles or tubes, which are pivotally connected at their ends so that the sections are foldable or collapsible upon one another. The side frame members support a link or cloth fabric over which a mattress is placed. The bed frame is supported when in the extended bed position by linkage mechanisms at the head end and by foldable legs at the center and foot end of the frame.

Typically, sofa sleepers are sold with either a relatively thin foam mattress or a thicker innerspring mattress. A relatively thin foam mattress requires less space and compresses much more easily than a heavier or thicker foam or innerspring mattress when the mattress is folded up within the sofa sleeper mechanism and inserted into the interior of the sofa sleeper frame. Because of this differential in space requirements and differential in force required to close the mechanism and compress the folded mattress within the mechanism, it has been proposed to use an automatic mechanism, such as the mechanism disclosed in U.S. Pat. No. 4,571,755, to effect the closing and final compression of a relatively thick innerspring mattress. But, that automatic mechanism is relatively expensive to manufacture because of its many links.

An alternative to the use of an automatic mechanism to house a relatively thick foam or innerspring mattress is to use a manually closable mechanism. But, when a manually closable mechanism is used to house thick foam or innerspring mattresses, the mechanisms are difficult to close. Additionally, the mechanisms are subject to spring-back or spring-up of the front leg of the mechanism into the face of the operator when the mechanism is unlocked during opening of the mechanism.

It has therefore been an objective of this invention to provide an improved and relatively inexpensive sofa sleeper mechanism which accommodates mattresses of differing thickness with substantially equal ease and without the uncontrolled spring-up or spring-back problem characteristic of prior art manual mechanisms when used to contain extra heavy or extra thick mattresses.

To accomplish this objective, the improved sofa sleeper mechanism of this invention comprises a manually operable sofa sleeper mechanism having a first locking mechanism for securing the foot section of the mechanism in a folded and locked condition relative to the intermediate and body section of the bed frame and a second lock or closing mechanism for further closing or compressing the mechanism and securing it in a collapsed, compressed and locked condition.

SUMMARY OF THE INVENTION

According to the practice of this invention, a foldable sofa sleeper mechanism is mounted upon a sofa frame in such a manner that it may be stored within a storage enclosure of the sofa frame. The mechanism includes a bed frame having pivotally interconnected head, body, intermediate and foot sections, as well as a mattress supporting fabric extended between opposed side rails of the sections. The bed frame is supported from the sofa sleeper frame by a pair of substantially identical linkage mechanisms located on opposite sides of the bed frame. Each linkage mechanism includes front and rear support links and a center leg connected to a bed lock plate and center leg actuating arm operable to retract the center leg beneath the body section of the frame when the mechanism is folded into the sofa frame and to extend the center leg into an unfolded vertical orientation beneath the center section of the bed frame when the bed frame is extended into a horizontal flat orientation. Each linkage mechanism further includes a leg lock link and a compression lock link connected between the bed lock plate and a front support leg of the mechanism for first moving and locking the front leg into juxtaposition with the foot section of the frame when the mechanism is initially closed or collapsed and for then further collapsing and locking the foot section of the frame in a fully collapsed position relative to the body section of the frame when the mechanism is fully collapsed.

The primary advantage of this double locking arrangement is that it enables mattresses of differing thickness to be folded into a manually closable mechanism and the mechanism to be folded into the sofa frame enclosure with nearly equal ease irrespective of the thickness of the mattress. It further is not subject to kickback of the foot section supporting leg of the mechanism when the mechanism is opened and the foot section released from a locked position relative to the body section which it overlies in the closed and locked position of the mechanism.

These and other objects and advantages of this invention will be more readily apparent from the following description of the drawings in which.

Figure 6:
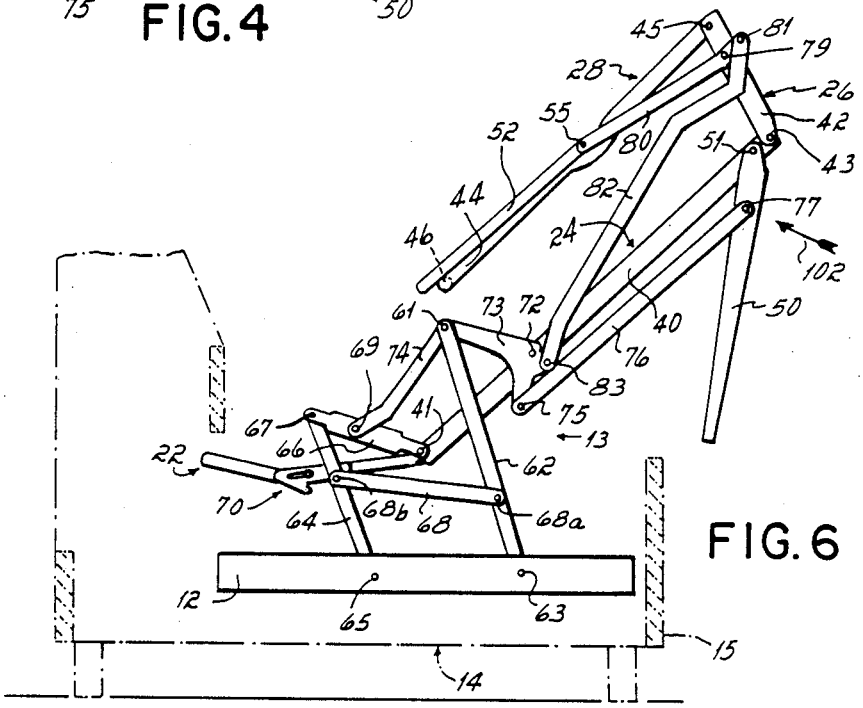
FIG. 6 is a side elevational view of the complete mechanism, but illustrating the mechanism in a position further folded from the position illustrated in FIG. 5.
Figure 7:
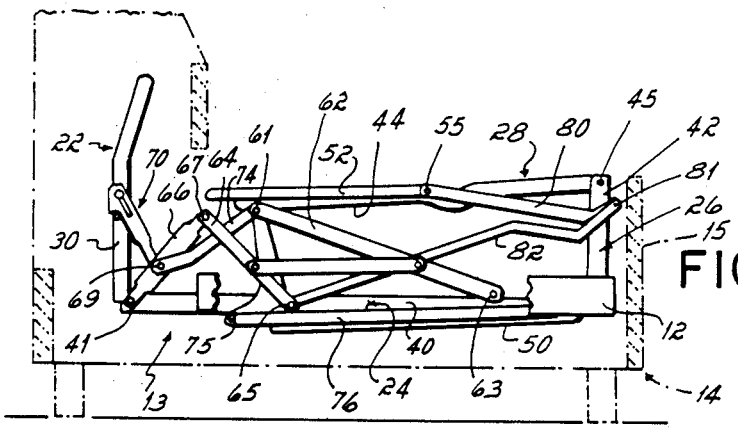
FIG. 7 is a side elevational view similar to FIG. 6, but illustrating the mechanism in a fully folded or collapsed position within the sofa sleeper frame.

Referring now to the drawings, it will be noted that the sofa sleeper mechanism 10 is supported from a pair of mounting plates 12 which are fixedly secured to an upholstered sofa frame, indicated generally by the numeral 14 (FIGS. 6–7). The upholstered sofa frame conventionally has a backrest cushion (not shown), a pair of side rails (not shown) and a fixed front rail 15 which define a generally rectangular storage enclosure for the folded mechanism 10 (FIG. 7). The sofa frame 14 per se does not form any part of the invention of this application and may comprise any standard upholstered frame.

The foldable sofa sleeper mechanism 10 comprises a bed frame 11 and a linkage mechanism 13 for supporting that frame 11 from the mounting plates 12. The bed frame 11 comprises a rear head section 22, a long body section 24 pivotally connected at one end to the head section 22, a short intermediate section 26 pivotally connected at one end to the other end of the body section 24, and a foot section 28 pivotally connected to the other end of the short intermediate section 26.

The head section 22 comprises symmetrically disposed left and right side members 30. In the illustrated embodiment, these side members are both angular shaped and tubular in configuration and are interconnected by a cross member 36 which comprises a transverse tubular section of the side members 30.

The body section 24, the short intermediate section 26, and the foot section 28 each comprises symmetrically disposed left and right side members 40, 42 and 44, respectively. The body section side frame members 40 and the intermediate section side members 42 are angular shaped in configuration, while the foot section side frame members 44 are illustrated as being tubular in configuration, although they could as well be angular or a combination of angular and tubular as in the case of the head section side members 30. A tubular transverse cross member 46 connects the forward ends of the foot section side members 44. In the preferred embodiment, the foot section side members 44 and the transverse cross member 46 are bent from a single unitary tube, but all of the side members could be formed from either tubes or angles or even channels.

The interconnected bed frame sections 22, 24, 26 and 28 are supported in their extended position by a pair of foldable center support legs 50 pivotally connected to the forward ends of the body section side members 40 by rivets 51. A generally U-shaped foot section support leg 52 is pivotally connected at its upper ends by rivets 53 to the foot section side members 44. A tubular cross member 54 interconnects the center legs 50 and is riveted thereto to provide the legs 50 with lateral stability.

A cross brace 56 extends between the opposite side members 40 of the body section 24. Similar cross braces 57, 58 extend between the side members 30 and 42 of the head and intermediate sections 22, 26, respectively, of the mechanism. The opposite ends of each of these cross braces 56, 57, 58 are fixedly attached to the side members of the body section, head section and intermediate section, respectively, of the mechanism so as to provide lateral stability to the bed frame.

Stretched between the side frame members of the head, body, intermediate and foot sections of the frame is a fabric 60 for supporting a mattress atop the mechanism. The fabric 60 may be a wire link fabric or a cloth fabric or any other conventional mattress supporting flexible fabric material. Such fabric materials are conventional and per se form no part of the invention of this application.

The interconnected sections 22, 24, 26 and 28 together form the rectangular bed frame 11 with curved corners when the mechanism 10 is fully pulled out. As may be seen in FIGS. 1 and 2, the sections lie in coplanar relationship, i.e., they all lie on the same horizontal plane and provide a resilient planar surface for supporting a mattress (not shown).

The foldable frames on both sides of the bed are similar and are symmetrically disposed. Since the means which connect the longitudinal portions of the bed frame on the right and left facing sides of the bed are similar and symmetrically disposed, only the connections on one side have been illustrated and will be described herein. However, in some instances, it is necessary to refer to the opposite side to find reference numerals. The side of the frame shown in FIGS. 2–7 is the left facing side of the bed which is the side on the left side of a person standing in front of the foot end of the bed and looking toward the head end of the bed.

The side members 30 of the head section 22 are pivotally connected to the rearward end of the side members 40 of the body section 24 by a rear rivet 41. This rivet connection enables the head section to pivot relative to the side members 40 of the body section.

The forward end of the side members 40 of the body section are pivotally connected to the intermediate frame section members 42 by a rivet 43. At the forward end, the intermediate frame section members 42 are pivotally connected by a rivet 45 to the rearward end of the side members 44 of the foot section 26 of the mechanism.

Figure 1:
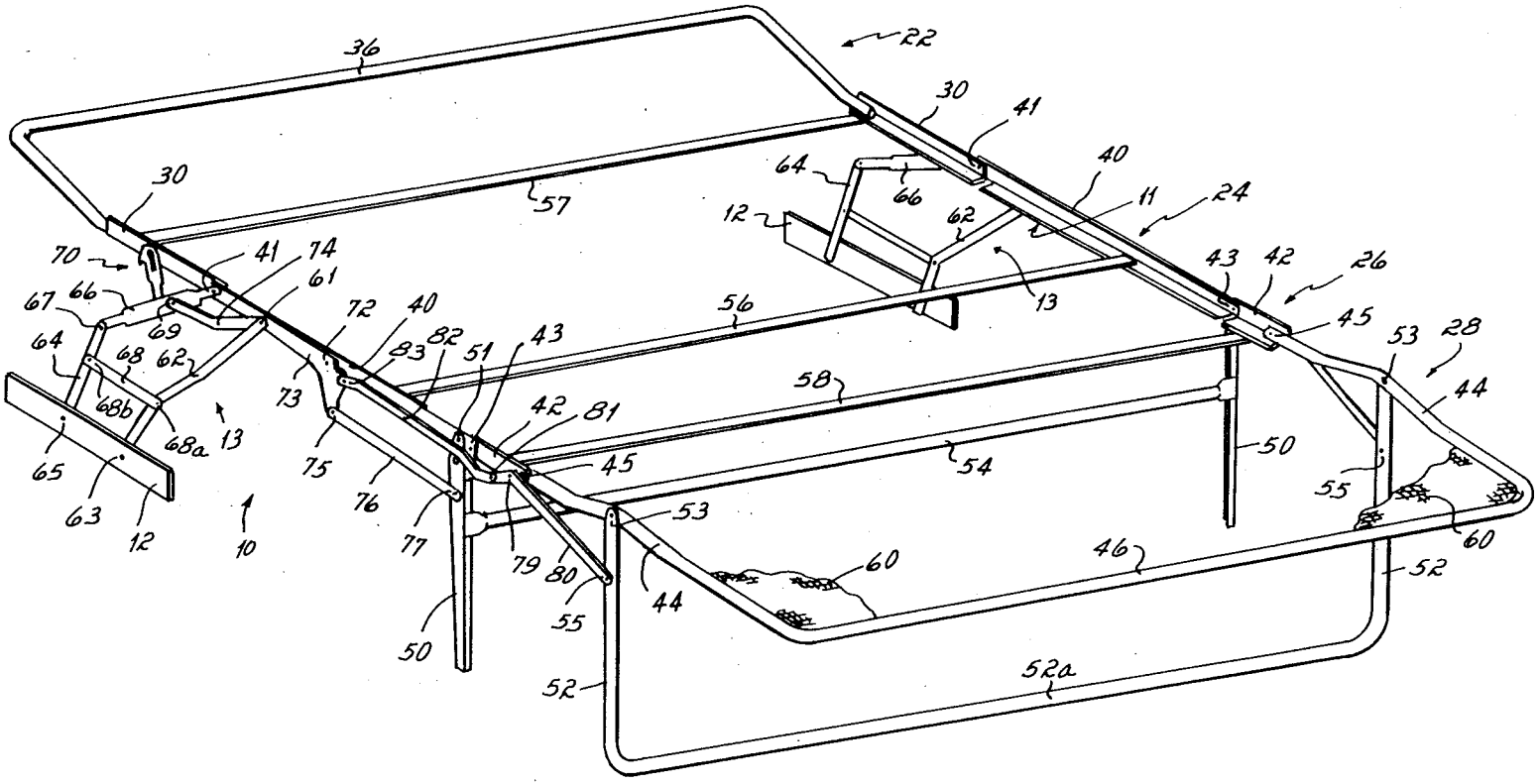
FIG. 1 is a perspective view of an unfolded sofa sleeper mechanism incorporating the invention of this application.

Referring now to FIGS. 1, 6 and 7, it will be seen that the sofa sleeper mechanism 10 is supported upon the sofa frame by a series of links supported from the mounting plate 12. This mounting plate is secured to the sofa frame 14 by conventional screws or fasteners (not shown). Pivotally mounted upon this mounting plate is a pilot arm 62, the lower end of which is pivotally connected to the mounting plate 12 by a rivet 63 and the upper end of which is pivotally connected to an actuating link 74 by a rivet 61.

A pair of interconnected lower and upper rear support links 64, 66, respectively, interconnect the head end of the side member 40 of the body supporting section 24 of the frame to the mounting plate 12. The lowermost one 64 of these links is pivotally attached to the mounting plate 12 by a rivet 65, and the upper end of the uppermost one 66 of these supporting links is pivotally secured to the rear of the side member of the body supporting section 24 of the frame by the rivet 41. The two links 64, 66 are interconnected at their upper and lower ends, respectively, by a rivet 67. The pilot arm 62 and the lower rear support link 64 are interconnected by a control link 68 which is pivotally connected to each link by a rivet **68*a* and 68*b***, respectively.

A conventional TV lock mechanism indicated generally by the numeral 70 interconnects the upper rear support link 66 with the side members of the head section of the frame. This conventional mechanism enables the head section of the frame to be pivoted and locked in an upwardly sloping position relative to the side members of the body section of the frame so as to facilitate TV viewing or reclining on the unfolded bed with the head end of the bed tilted upwardly. Since this mechanism 70 is conventional and forms no part of the invention of this application, it has not been described in detail herein.

The actuating link 74 is pivotally connected to the upper rear supporting link 66 by a rivet 69 located medially between the rivets 67 and 41. It is also connected to the upper end of the pilot arm 62 and to a bed lock plate 73 by the rivet 61. The bed lock plate 73 is shaped as a bell crank and may be referred to herein as either a bed lock plate or a bell crank.

In the unfolded condition of the sofa sleeper mechanism 10, the bed lock plate 73 extends forwardly from its pivotal connection 61 with the upper end of the pilot arm 62 and the actuating link 74. At its forward end, the bed lock plate is supported for rotation about a rivet 72 which connects the bed lock plate to the side member 40 of the body section of the bed frame 11. The bed lock plate is also pivotally connected by a rivet connector 75 with a center leg actuating arm 76 and by a rivet connector 83 with a compression lock link 82. At its forward end, the actuating arm 76 is pivotally connected to the center leg 50 via a rivet connector 77. As is conventional in such foldable sofa sleeper mechanisms, the actuating link 74 cooperates with the bed lock plate 73 and actuating arm 76 to effect inward folding or collapsing of the center leg 50 about its pivotal connection 51 against the side member 40 of the body section of the frame when the mechanism is collapsed during folding into the sofa frame 14.

In order to actuate the front leg 52 upon closing of the mechanism so as to cause the front leg to move upwardly toward a position in which the transverse leg tube **52*a* is located in juxtaposition to the transverse tube 46 of the foot section of the frame, a pair of links, the compression lock link 82 and a leg lock link 80 interconnect the upper end of the front leg 52 with the side member 42 of the intermediate section 26 of the frame and with the bed lock plate 73**, respectively.

At its forward end, the leg lock link 80 is pivotally connected to the upper end of the front leg 52 by a rivet 55, and at its rearward end, is pivotally connected by a rivet 79 to the side member 42 and by a rivet 81 to the rearward end of the compression lock link 82. The compression lock link 82 is pivotally connected via the rivet 83 to the bed lock plate 73. This connection of the front leg to the side member 42 of the bed frame and to the bed lock plate 73 is operative to collapse the front leg of the frame into juxtaposition with the foot section of the mechanism when the mechanism is collapsed preparatory to being folded into the sofa sleeper frame, as is explained more fully hereinafter.

MECHANISM OPERATION

Figure 2:
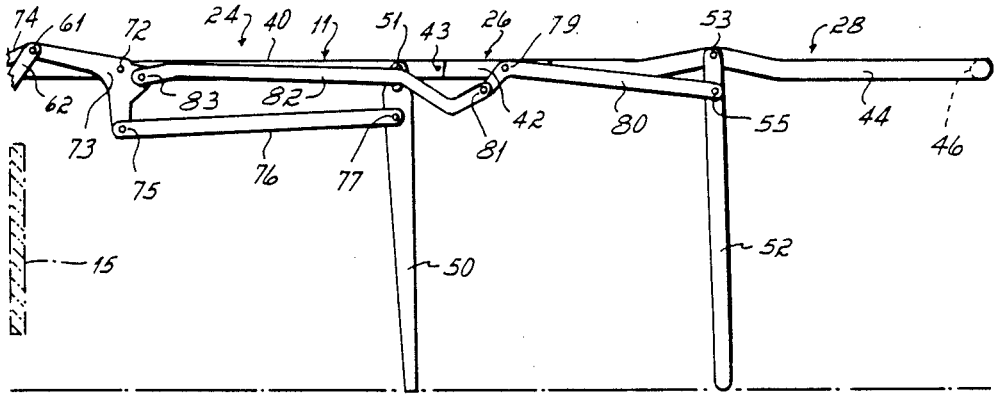
FIG. 2 is a side elevational view of the foot end portion of the mechanism of FIG. 1.
Figure 3:
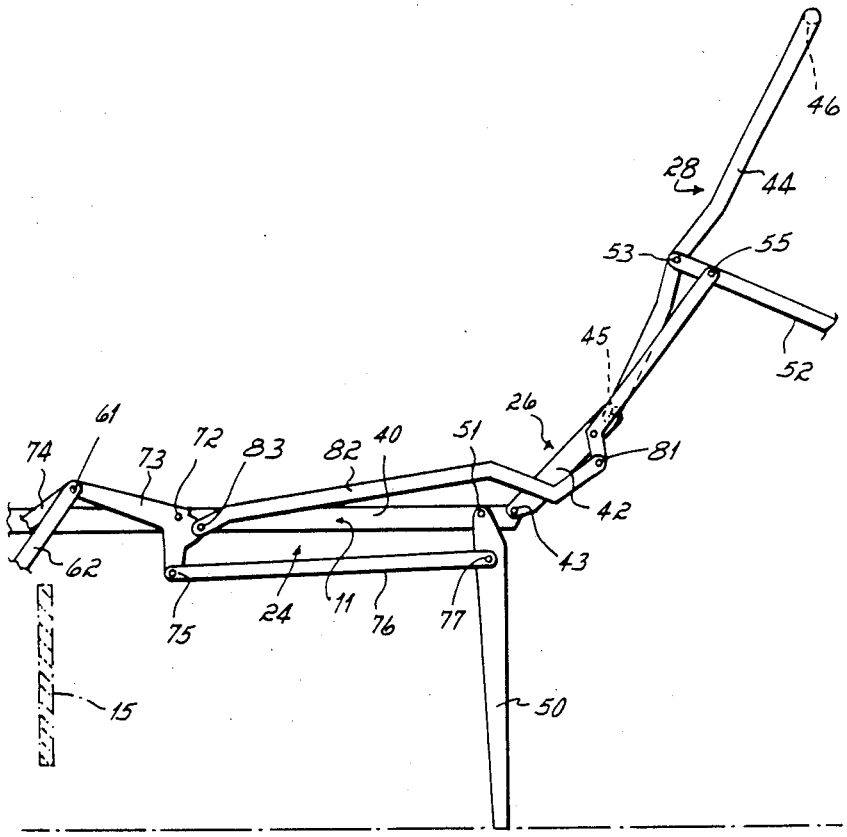
FIG. 3 is a view similar to FIG. 2, but illustrating the foot end portion of the mechanism in a partially folded condition.
Figure 4:
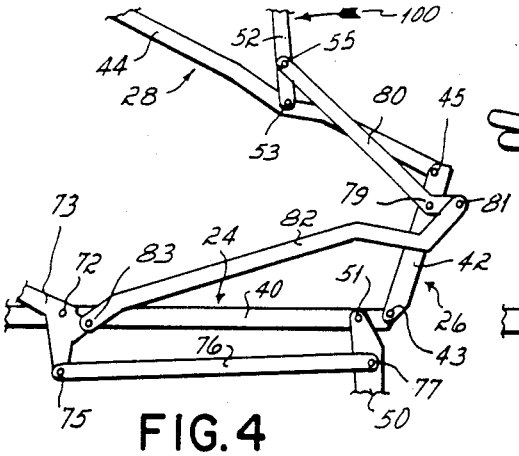
FIG. 4 is a side elevational view, similar to FIG. 3, but illustrating the mechanism in a position further folded from the position of FIG. 3.

Folding of the mechanism into the cavity of the sofa frame 14 from the flat bed position illustrated in FIGS. 1 and 2 to the collapsed position of the sofa mechanism within the storage enclosure of the sofa sleeper frame 14 is initiated by first lifting the front tubular cross member 46 of the foot section of the mechanism until that foot section is located very nearly in a vertical plane. As a consequence of this upward movement, the front leg 52 is caused by the leg lock link 80 and the compression lock link 82 to be partially collapsed toward juxtaposition with the side members 44 of the foot section 28 of the mechanism.

With the front leg 52 located in or near a vertical orientation, the transverse leg tube **52*a* is grasped and pushed, as indicated by the arrow 100 (FIG. 4), toward the transverse cross member 46 of the front section of the bed frame. The initial lifting of the front tubular cross member 46 of the foot section 28 causes the bed frame to pivot about the pivot point or rivet 43 connecting the intermediate frame section 26 to the body section 24, thereby lifting the intermediate frame section 26 into a generally vertical position. Subsequent grasping and pushing of the transverse crossbar 52*a* of the front legs 52 causes the foot section 28 to pivot relative to the intermediate section 26 about the rivets 45 between those two sections as the foot section 28 is moved toward a horizontal plane overlying the body section 24. As the transverse leg tube 52*a* approaches the foot section cross tube 46, the pivot 53 between the front leg 52 and the foot section side member 44 moves over center relative to a line 101 (FIGS. 8 and 9) drawn between the pivotal rivet connections 55 and 79 of the leg lock link 80. As a consequence of this over-center movement, the foot section 28 of the bed frame locks in a folded position relative to the intermediate section 26**.

Figure 8:
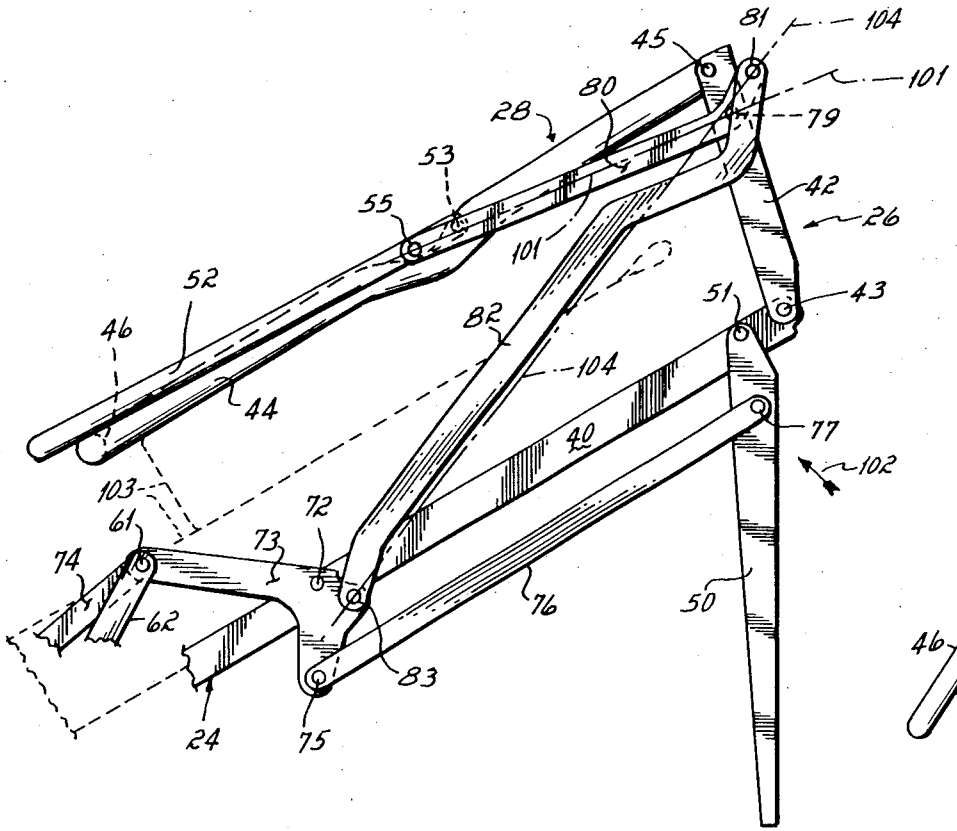
FIG. 8 is an enlarged view similar to FIG. 6, but of the end portion only of the mechanism.

Continued folding movement of the mechanism is then effected by lifting the cross tie member 58 upwardly, as indicated by the arrow 102 in FIGS. 6 and 8, so as to lift what is now the front of the partially folded mechanism, including the center leg 50, upwardly. This upward movement of the folded foot and intermediate sections of the frame causes the bed lock plate 73 to be rotated about the rivet 72 by the pilot arm 62 and actuating link 74. Thereby, the actuating arm 76 is caused by its connection to the bed lock plate 73 to collapse the center legs 50 beneath the body section 24 of the frame. Simultaneously, rotation of the bed lock plate 73 causes the compression lock link 82 to be pulled by the pivot connection 83 toward the head section of the folded frame as the bed lock plate 73 rotates in a clockwise direction (as viewed in FIGS. 6, 8 and 9). Thereby the intermediate section 26 of the frame is caused to pivot about the rivet 43 between the body section 24 and intermediate section 26 to further collapse the front section 28 toward the body section 24. This further collapse of the foot section 28 toward the body section 24 effected by the compression lock link 82 is intended to further compress a folded mattress 103 indicated by the dashed lines of FIGS. 8 and 9 beyond the compression which is effected by the folding and locking of the front leg 52 and compression lock link 80.

Figure 9:
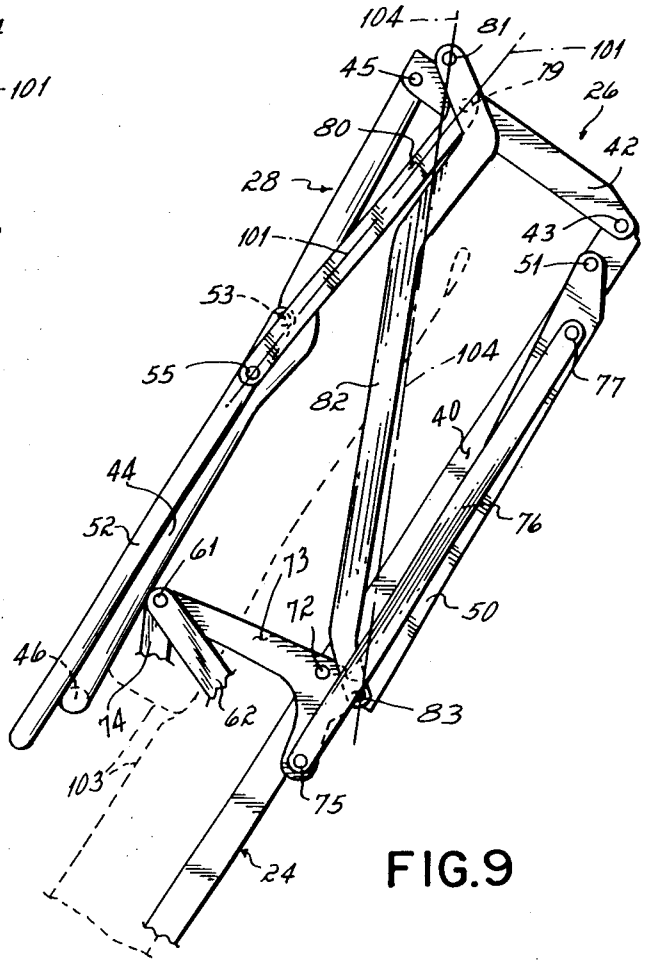
FIG. 9 is a view similar to FIG. 8, but illustrating the mechanism in a further folded position from the position illustrated in FIG. 8.

As can be seen in a comparison of FIGS. 8 and 9, the collapse of the transverse tube 46 of the foot section 28 toward the body section 24 continues as a consequence of the counterclockwise rotation of the bed lock plate 73. As a consequence of this movement, the pivot 79 moves below or over center relative to a line 104 drawn through the pivots 83 and 81. When the pivot 79 moves over center relative to the line 104 drawn through the pivots 83, 81, it locks the intermediate section of the frame in an angled position relative to the body section. Thus, there are two locks for securing the foot section 28 of the bed frame in a position of general parallelism with the body section: The first lock 52, 80 for securing the foot section 28 in an angled position relative to the intermediate section 26, and the second lock 73, 82, 80 for securing the intermediate section 26 in an angled position relative to body section 24.

Continued lifting of the front section of the folded leg and intermediate sections of the frame causes the rear end of the body section of the mechanism to be lowered and moved rearwardly. Simultaneously, the head section 22 is moved into an inclined position with respect to the body section 24 preparatory to the head section of the frame being moved up into the cavity in the backrest section of the sofa frame. On further movement of the folded frame, the head section continues to rotate until the head section is generally perpendicular to the body section and the body section is located in a horizontal plane internally of the enclosure of the sofa frame, as illustrated in FIGS. 6 and 7.

The mechanism 10 described hereinabove and the manner in which it is folded into the enclosure of the sofa frame 14 and unfolded therefrom into the flat bed position illustrated in FIGS. 1 and 2 is conventional except for the double-lock mechanism 73, 82, 80 for folding and locking the foot section 28 in a collapsed position relative to the body section 24. Therefore, the manner in which this conventional mechanism folds into and may be folded from the sofa frame 14 has not been described in great detail herein. In fact, the head section and head section folding mechanisms of other conventional mechanisms could as well be utilized in the practice of this invention.

Double-Lock Mechanism

The sofa sleeper mechanism 10 described hereinabove differs from prior art manually lockable sofa sleepers principally in that it adds to that prior art manually lockable sofa sleeper mechanism the compression lock link 82 which extends between the bed lock plate 73 (sometimes referred to as a bell crank) and the leg lock link 80. The addition of these links provides additional compression of the foot section 28 relative to the body section 24 beyond that which is normally available in conventional or prior art manually lockable sofa sleeper mechanisms. This additional compression is intended to be used in order to enable extra thick mattresses to be compressed and then locked in a standard size sofa sleeper mechanism, which standard sofa sleeper mechanism is intended to only handle mattresses of lesser thickness.

Figure 5:
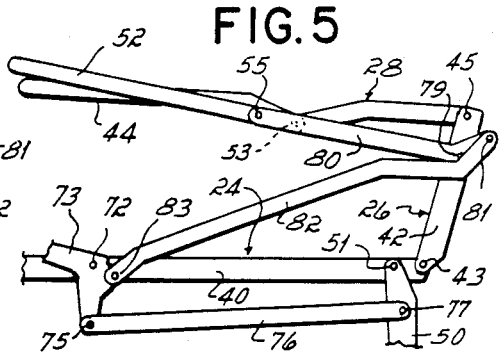
FIG. 5 is a side elevational view, similar to FIG. 4, but illustrating the mechanism in a position further folded from the position of FIG. 4.

One advantage of adding the compression lock link 82 with its connection to the bed lock plate 73 and leg lock link 80 is that it enables the sofa sleeper mechanism 10 to first be folded to the locked condition illustrated in FIG. 5 wherein the foot section 28 of the sofa sleeper frame is folded over and locked generally parallel to the body section 24, and then to be further compressed relative to the body section as the second lock comprising the bed lock plate 73, compression lock link 82 and leg lock link 80 moves through and beyond an over-center locked condition. By utilizing two locks, there is no tendency when the sofa sleeper mechanism is opened for the front leg 52 to fly upwardly and even strike the face of a person opening the mechanism when the mechanism moves out of a locked, over-center condition. Such uncontrolled movement of the front support leg can result from containment of an oversized mattress within a conventional manual sofa sleeper mechanism if that mechanism does not include a second over-center lock.

While I have described only a single preferred embodiment of my invention, persons skilled in this art will appreciate changes and modifications which may be made without departing from the spirit of my invention. Therefore, I do not intend to be limited except by the scope of the following appended claims.

I claim:

1. A foldable sofa sleeper mechanism adapted to be mounted upon a sofa frame and stored within a storage enclosure of the sofa frame, said mechanism comprising a bed frame having pivotally interconnected head, body, intermediate and foot sections each having a pair of opposed side rails, a mattress supporting fabric extending between said sections and connected thereto, linkage mechanism for supporting said bed frame from the sofa frame, said linkage mechanism comprising a pair of center legs connected to a center leg actuating means including a bed lock plate operable to retract and extend said center legs, said linkage means further comprising a pair of front legs pivotally connected to said foot section of said bed frame and interconnected by a transverse leg brace, said sofa sleeper mechanism being movable between a folded position in which said bed frame and said linkage mechanism is contained within said storage enclosure of said sofa frame and said center legs and front legs are retracted, and an extended unfolded position in which said bed frame extends forwardly from said sofa frame and said center legs and front legs extend downwardly from said bed frame, front leg actuating means including a single leg lock link and a single compression lock link extending between and interconnecting said bed lock plate and one of said front legs, said compression lock link being pivotally connected at one end to said bed lock plate and at the other end to one end of said leg lock link, an opposite end of said leg lock link being pivotally connected to said one of said front legs, and said leg lock link being pivotally connected intermediate its ends to said intermediate section of said bed frame, said front leg actuating means being operable when said sofa sleeper mechanism is moved to a folded position to lock said foot section relative to said intermediate section in a position in which the foot section overlies and is generally parallel to said body section of said bed frame, and then to subsequently move said intermediate section of said bed frame relative to said body section upon movement of said compression lock link as said folded sofa sleeper mechanism is moved into said storage enclosure of said sofa frame.

2. The sofa sleeper mechanism of claim 1 in which a pivot connection between said foot section of said bed frame and said one of said front legs moves over center and locks said one of said front legs relative to said foot section of said bed frame when said mechanism is collapsed.

3. The sofa sleeper mechanism of claim 2 in which said pivot connection between said foot section of said bed frame and said one of said front legs moves over center relative to a line drawn between a first pivot connection between said one of said front legs and said foot section of said bed frame and a second pivot connection between said leg lock link and said intermediate section of said bed frame.

4. The sofa sleeper mechanism of claim 2 in which a pivot connection between said leg lock link and said intermediate section of said bed frame moves over center and locks said intermediate section of said bed frame relative to said body section of said bed frame when said mechanism is collapsed.

5. The sofa sleeper mechanism of claim 4 in which said pivot connection between said leg lock link and said intermediate section of said bed frame moves over center relative to a line drawn from a first pivot connection between said compression lock link and said bed lock plate and a second pivot connection between said compression lock link and said leg lock link.

* * * * *